US005797236A

United States Patent [19]

Posey, Jr. et al.

[11] Patent Number: 5,797,236

[45] Date of Patent: Aug. 25, 1998

[54] AUXILIARY BOTTOM INSERT APPARATUS FOR A CONTAINER

[76] Inventors: John T. Posey, Jr.; Julea Ruth Posey, both of HC 68 Box 1065, Vian, Okla. 74962

[21] Appl. No.: 711,104

[22] Filed: Sep. 9, 1996

[51] Int. Cl.[6] ..... E04C 2/42; E04C 5/04; E04F 15/06; E04F 19/10

[52] U.S. Cl. ..... 52/664; 52/668; 52/763; 52/506.1; 52/799.12; 403/346

[58] Field of Search ..... 52/664, 668, 506.1, 52/799.12, 763; 403/346, 347, 400

[56] References Cited

U.S. PATENT DOCUMENTS

| | | | |
|---|---|---|---|
| 4,034,534 | 7/1977 | Taylor | 403/347 X |
| 4,133,160 | 1/1979 | Segil | 52/664 X |
| 4,532,749 | 8/1985 | Perk | 52/668 |
| 4,757,663 | 7/1988 | Kuhr | 52/664 |
| 4,785,604 | 11/1988 | Johnson, Jr. | 52/664 X |
| 5,241,799 | 9/1993 | Jahn | 52/664 X |

*Primary Examiner*—Creighton Smith
*Assistant Examiner*—W. Glenn Edwards

[57] ABSTRACT

An auxiliary bottom insert apparatus for a container includes first panels, each of which includes a first panel top edge, a first panel middle portion, and a first panel bottom edge. Each of the first panels includes first keyways spaced at predetermined first increments along the first panel top edge and extending from the first panel top edge to the first panel middle portion. Second panels are provided, wherein each of second panels includes a second panel top edge, a second panel middle portion, and a second panel bottom edge. Each of the second panels includes second keyways spaced at predetermined second increments along the second panel top edge and extending from the second panel top edge to the second panel middle portion. The second panels are inverted with respect to the first panels. Each of the first panel middle portions is inserted in a corresponding one of the second keyways and each of the second panel middle portions is inserted in a corresponding one of the first keyways, whereby the first panels and the second panels form a panel gridwork. The gridwork is in a form of a matrix. The first panels form matrix rows. The second panels form matrix columns. Elements of the matrix are formed by ordered pairs of the first keyways and the second keyways.

7 Claims, 3 Drawing Sheets

FIG 1
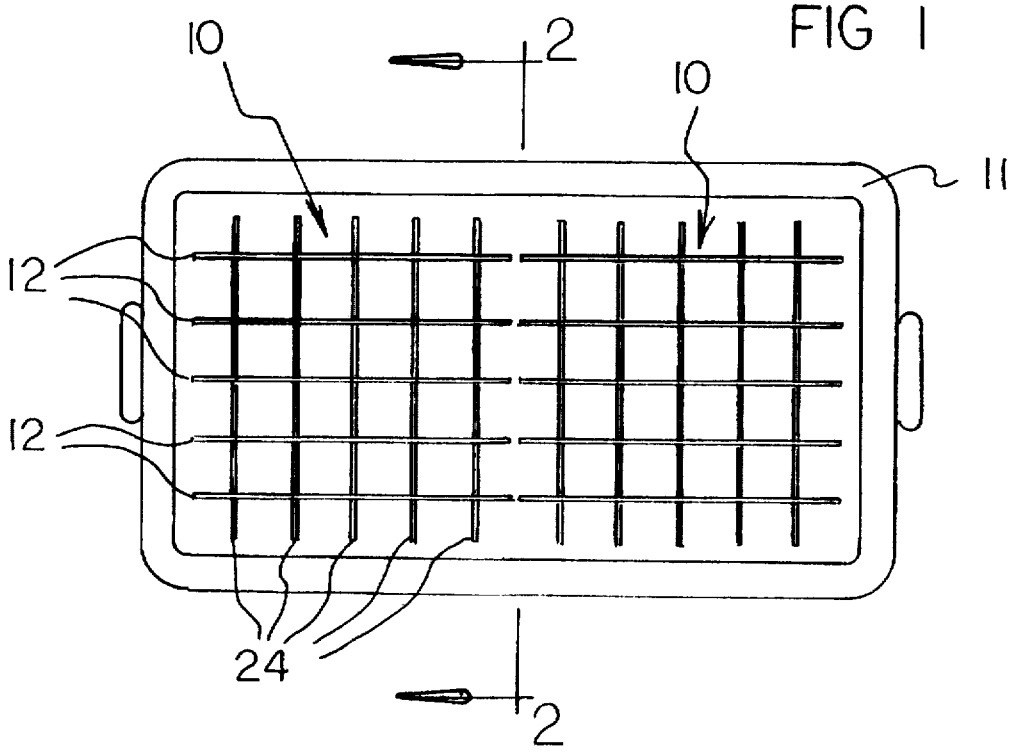
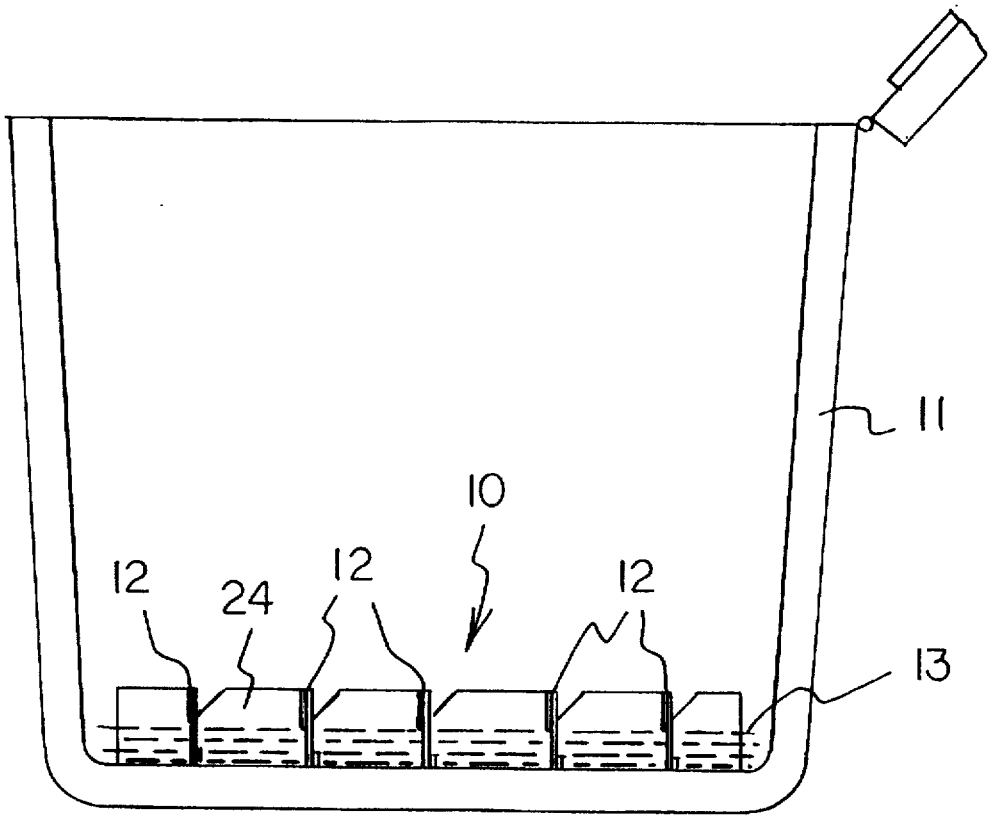
FIG 2

FIG 3
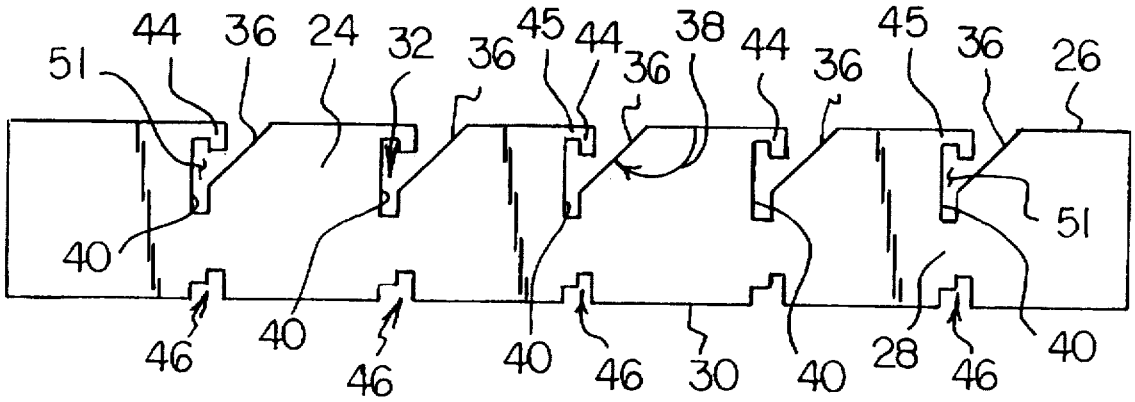
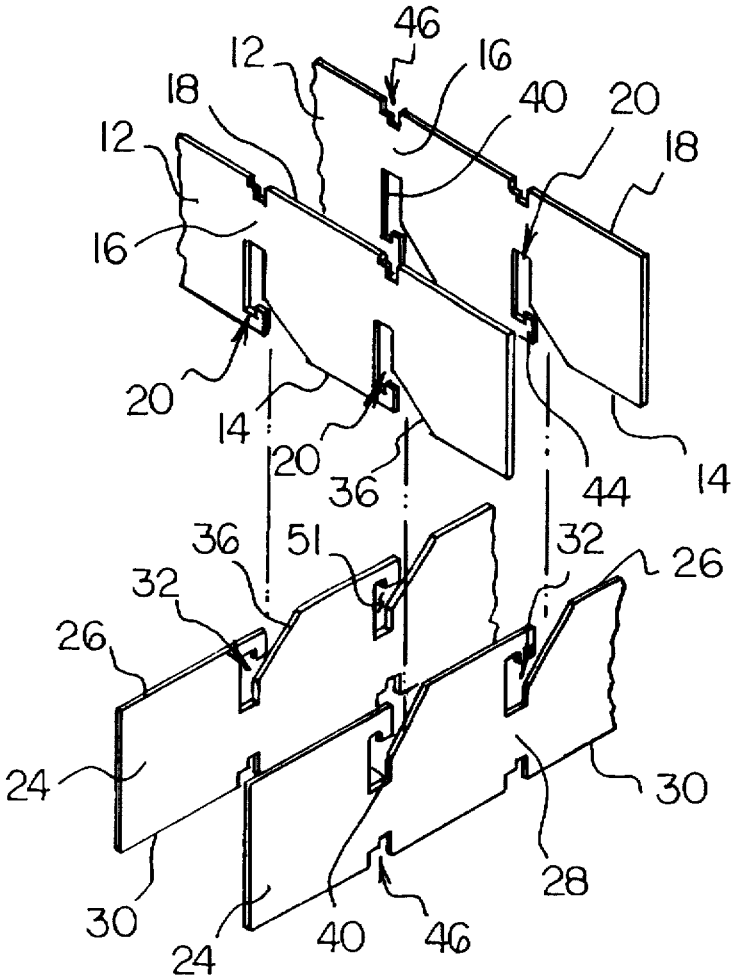
FIG 5

AUXILIARY BOTTOM INSERT APPARATUS FOR A CONTAINER

BACKGROUND OF THE INVENTION

1. Field of the Invention

The present invention relates generally to containers and, more particularly, to portable, insulated cooler devices.

2. Description of the Prior Art

Portable, insulated cooler devices are popular and are in wide use. Often bags of ice are placed inside a cooler device to provide a cooling environment for material, such as food, that is placed inside the cooler device. Over time, the ice melts to some degree forming liquid water. Often the bags containing the ice will have one or more holes therein, and, as a result liquid water escapes from the ice bags. When food items in the cooler device are on the floor of the cooler device, the food items may become wetted by the liquid water. Wetting of the food items by the liquid water is an undesirable result. The food items may become soggy and inedible resulting in wasted food. In this respect, it would be desirable if a cooler were provided with a device which prevented food items on the floor of the cooler device from being wetted by liquid water that results from melted ice.

Coolers come in a wide variety of sizes. In this respect, it would be desirable if a device were provided which can retrofit a wide variety of cooler devices to prevent food items on the floor of the cooler device from being wetted by liquid water that results from melted ice. More specifically, cooler come in a variety of lengths and a variety of widths. In this respect, it would be desirable if a device were provided which can be adjusted with respect to length and can adjusted with respect to width to retrofit cooler devices which have a variety of lengths and widths.

Throughout the years, a number of innovations have been developed relating to portable cooler devices, and the following U.S. Pat. Nos. are representative of some of those innovations: 4,424,687; 4,515,421; 5,052,184; 5,052,185; and 5,341,657. Among the patents listed above, the following patent are of special interest for their disclosure of devices to be inserted into cooler devices to provide an auxiliary, elevated floor for the cooler device: 4,424,687; 5,052,184; and 5,052,185.

More specifically, each of U.S. Pat. Nos. 4,424,687, 5,052,184, and 5,052,185 discloses some sort of horizontal platform that is supported by some sort of vertically oriented support structure which, in turn, is supported by the floor of the cooler device. For purposes of simplicity, it would be desirable if an auxiliary bottom insert device could be provided for a cooler which does not employ horizontal platforms that are supported by vertically oriented support structures.

Still other features would be desirable in an auxiliary bottom insert apparatus for a container. It would be desirable if an insert that is generally used as an auxiliary floor unit could also optionally be used as a vertical divider to divide the interior of the cooler device into a plurality of compartments. In this respect, it would also be desirable if an insert that is generally used as an auxiliary floor unit could also optionally be used as a support structure for supporting a vertical divider that divides the interior of the cooler device into a plurality of compartments.

Thus, while the foregoing body of prior art indicates it to be well known to use auxiliary bottom inserts for a cooler containers, the prior art described above does not teach or suggest an auxiliary bottom insert apparatus for a container which has the following combination of desirable features: (1) prevents food items on the floor of the cooler device from being wetted by liquid water that results from melted ice; (2) can retrofit a wide variety of cooler devices; (3) can be adjusted with respect to length and can adjusted with respect to width to retrofit cooler devices which have a variety of lengths and widths; (4) does not employ horizontal platforms that are supported by vertically oriented support structures; (5) provides an auxiliary floor unit that can optionally be used as a vertical divider to divide the interior of the cooler device into a plurality of compartments; and (6) provides an auxiliary floor unit that can optionally be used as a support structure for supporting a vertical divider that divides the interior of the cooler device into a plurality of compartments. The foregoing desired characteristics are provided by the unique auxiliary bottom insert apparatus for a container of the present invention as will be made apparent from the following description thereof. Other advantages of the present invention over the prior art also will be rendered evident.

SUMMARY OF THE INVENTION

To achieve the foregoing and other advantages, the present invention, briefly described, provides an auxiliary bottom insert apparatus for a container which includes first panels, each of which includes a first panel top edge, a first panel middle portion, and a first panel bottom edge. Each of the first panels includes first keyways spaced at predetermined first increments along the first panel top edge and extending from the first panel top edge to the first panel middle portion. Second panels are provided, wherein each of second panels includes a second panel top edge, a second panel middle portion, and a second panel bottom edge. Each of the second panels includes second keyways spaced at predetermined second increments along the second panel top edge and extending from the second panel top edge to the second panel middle portion. The second panels are inverted with respect to the first panels. Each of the first panel middle portions is inserted in a corresponding one of the second keyways and each of the second panel middle portions is inserted in a corresponding one of the first keyways, whereby the first panels and the second panels form a panel gridwork.

The gridwork has a first dimension and a second dimension, and the first panels are set out at increments along a first dimension of the gridwork, and the first panels are perpendicular to the first dimension and parallel to the second dimension. The first keyways are set out at increments along the first panels, and the second panels are set out at increments along a second dimension of the gridwork. The second panels are perpendicular to the second dimension and parallel to the first dimension, and the second keyways are set out at increments along the second panels.

The gridwork is in a form of a matrix. The first panels form matrix rows. The second panels form matrix columns. Elements of the matrix are formed by ordered pairs of the first keyways and the second keyways. The first panels and the second panels includes identical dimensions and identical keyways.

Each of the first keyways and the second keyways includes a ramp portion extending from a respective top panel edge to a respective middle panel portion at an obtuse ramp angle with respect to the respective top panel edge. A key-reception well extends into a respective middle panel portion from the ramp angle. The ramp angle is approximately one hundred thirty-five degrees. A pair of walls of each of the key-reception wells are oriented at right angles to the respective top panel edge and the respective bottom panel edge of a respective panel.

Each of the first panels and the second panels includes a plurality of flexible lock tabs, wherein each lock tab extends toward a respective middle panel portion and is positioned over a portion of a respective keyway. A plurality of lock-tab-receiving notches are provided, wherein each lock-tab-receiving notch extends from a respective panel bottom edge toward a respective the middle panel portion. Each of the lock tabs and each of the key-reception wells is positioned on opposite sides of a respective panel middle portion. Each lock tab is L-shaped, having a horizontal strut portion and a vertical strut portion. Each lock-tab-receiving notch is a complementary L-shape. For each panel, a space between each key-reception well of each keyway and each horizontal strut portion forms a panel-middle-portion reception space.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved auxiliary bottom insert apparatus for a container which has all of the advantages of the prior art and none of the disadvantages.

It is another object of the present invention to provide a new and improved auxiliary bottom insert apparatus for a container which may be easily and efficiently manufactured and marketed.

It is a further object of the present invention to provide a new and improved auxiliary bottom insert apparatus for a container which is of durable and reliable construction.

An even further object of the present invention is to provide a new and improved auxiliary bottom insert apparatus for a container which is susceptible of a low cost of manufacture with regard to both materials and labor, and which accordingly is then susceptible of low prices of sale to the consuming public, thereby making such auxiliary bottom insert apparatus for a container available to the buying public.

Still yet a further object of the present invention is to provide a new and improved auxiliary bottom insert apparatus for a container which prevents food items on the floor of the cooler device from being wetted by liquid water that results from melted ice.

Still another object of the present invention is to provide a new and improved auxiliary bottom insert apparatus for a container that can retrofit a wide variety of cooler devices.

Yet another object of the present invention is to provide a new and improved auxiliary bottom insert apparatus for a container which can be adjusted with respect to length and can adjusted with respect to width to retrofit cooler devices which have a variety of lengths and widths.

Even another object of the present invention is to provide a new and improved auxiliary bottom insert apparatus for a container that does not employ horizontal platforms that are supported by vertically oriented support structures.

Still a further object of the present invention is to provide a new and improved auxiliary bottom insert apparatus for a container which provides an auxiliary floor unit that can optionally be used as a vertical divider to divide the interior of the cooler device into a plurality of compartments.

Yet another object of the present invention is to provide a new and improved auxiliary bottom insert apparatus for a container that provides an auxiliary floor unit that can optionally be used as a support structure for supporting a vertical divider that divides the interior of the cooler device into a plurality of compartments.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a top view of an embodiment of the auxiliary bottom insert apparatus for a container installed on the floor of a portable cooler device.

FIG. 2 is an enlarged cross-sectional view of the embodiment of the invention shown in FIG. 1 taken along line 2—2 thereof.

FIG. 3 is a side view of a single grid member in the embodiment of the invention shown in FIGS. 1 and 2.

FIG. 5 is an exploded view of the portion of the embodiment of the invention shown in FIG. 4.

DESCRIPTION OF THE PREFERRED EMBODIMENT

With reference to the drawings, a new and improved auxiliary bottom insert apparatus for a container embodying the principles and concepts of the present invention will be described.

Figure 4:
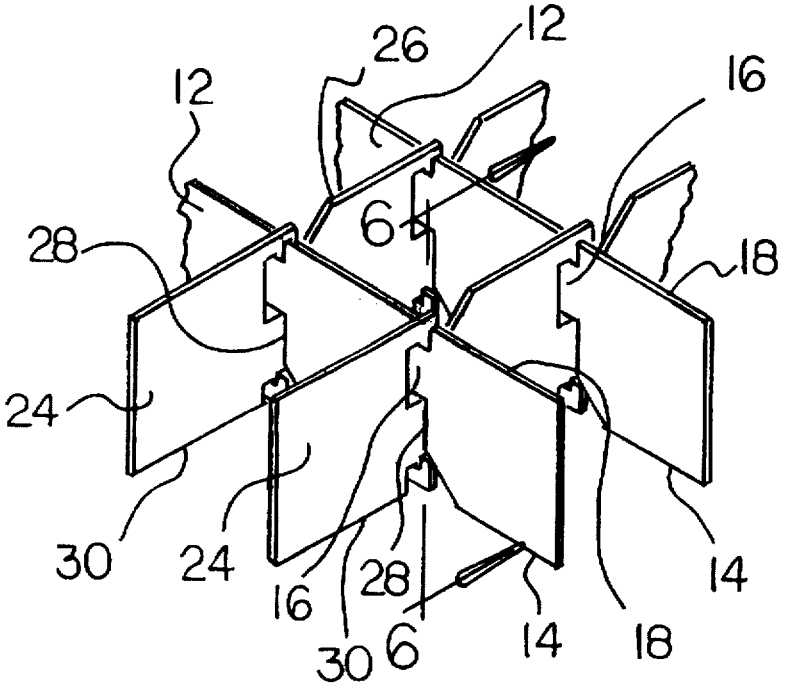
FIG. 4 is an elevated perspective view of a corner portion of the embodiment of the invention shown in FIGS. 1 and 2, removed from the container.
Figure 6:
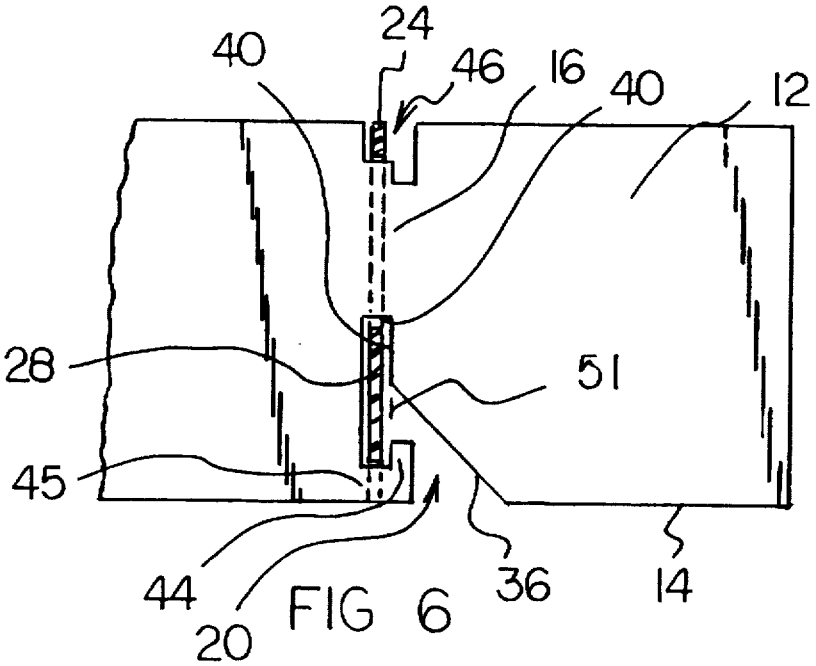
FIG. 6 is an enlarged cross-sectional view of a portion of the embodiment of the invention shown in FIG. 4 taken along line 6—6 thereof.

Turning to FIGS. 1–6, there is shown a preferred embodiment of the auxiliary bottom insert apparatus for a container of the invention generally designated by reference numeral 10. In its preferred form, an auxiliary bottom insert apparatus 10 for a container 11 includes first panels 12, each of which includes a first panel top edge 14, a first panel middle portion 16, and a first panel bottom edge 18. Each of the first panels 12 includes first keyways 20 spaced at predetermined first increments along the first panel top edge 14 and extending from the first panel top edge 14 to the first panel middle portion 16. Second panels 24 are provided, wherein each of second panels 24 includes a second panel top edge 26, a second panel middle portion 28, and a second panel bottom edge 30. Each of the second panels 24 includes second keyways 32 spaced at predetermined second increments along the second panel top edge 26 and extending from the second panel top edge 26 to the second panel middle portion 28. The second panels 24 are inverted with respect to the first panels 12. Each of the first panel middle portions 16 is inserted in a corresponding one of the second keyways 32 and each of the second panel middle portions 28 is inserted in a corresponding one of the first keyways 20, whereby the first panels 12 and the second panels 24 form a panel gridwork.

The gridwork has a first dimension and a second dimension, and the first panels 12 are set out at increments along a first dimension of the gridwork, and the first panels 12 are perpendicular to the first dimension and parallel to the second dimension. The first keyways 20 are set out at increments along the first panels 12, and the second panels 24 are set out at increments along a second dimension of the gridwork. The second panels 24 are perpendicular to the second dimension and parallel to the first dimension, and the second keyways 32 are set out at increments along the second panels 24.

The gridwork is in a form of a matrix. The first panels 12 form matrix rows. The second panels 24 form matrix columns. Elements of the matrix are formed by ordered pairs of the first keyways 20 and the second keyways 32. The first panels 12 and the second panels 24 includes identical dimensions and identical keyways. In other words, the same blank can be used for both the first panels 12 and the second panels 24.

Each of the first keyways 20 and the second keyways 32 includes a ramp portion 36 extending from a respective top panel edge to a respective middle panel portion at an obtuse ramp angle 38 with respect to the respective top panel edge. A key-reception well 40 extends into a respective middle panel portion from the ramp angle 38. The ramp angle 38 is approximately one hundred thirty-five degrees. A pair of walls of each of the key-reception wells 40 are oriented at right angles to the respective top panel edge and the respective bottom panel edge of a respective panel.

Each of the first panels 12 and the second panels 24 includes a plurality of flexible lock tabs, wherein each lock tab extends toward a respective middle panel portion and is positioned over a portion of a respective keyway. A plurality of lock-tab-receiving notches 46 are provided, wherein each lock-tab-receiving notch 46 extends from a respective panel bottom edge toward a respective the middle panel portion. Each of the lock tabs and each of the key-reception wells 40 is positioned on opposite sides of a respective panel middle portion. Each lock tab is L-shaped, having a horizontal strut portion 45 and a vertical strut portion 44. Each lock-tab-receiving notch 46 is a complementary L-shape. For each panel, a space between each key-reception well 40 of each keyway and each horizontal strut portion 45 forms a panel-middle-portion reception space 51.

As shown in FIG. 1, a pair of auxiliary bottom insert apparatuses 10 of the invention are employed at the bottom of a container 11 which is a cooler device. Each of the auxiliary bottom insert apparatuses 10 has five first panels 12 and five second panels 24 which form a matrix has five rows and five columns. Each of the auxiliary bottom insert apparatuses 10 has twenty-five elements formed by the intersection of the five rows and five columns of panels.

As shown in FIG. 2, the top edges of the panels 12 and 24 are located above the water level 13 of a quantity of water that is pooled at the bottom of the container 11. Therefore, articles that are placed on top of the auxiliary bottom insert apparatuses 10 are supported above the water level 13 and are not immersed in the water.

Each of the first panels 12 and each of the second panels 24 are identical to each other. A second panel 24 is shown in greatest detail in FIG. 3. The shown second panel 24 has five second keyways 32.

To assemble an auxiliary bottom insert apparatus 10 of the invention. A set of first panels 12 and a set of second panels 24 are obtained. The second panels 24 are inverted with respect to the first panels 12. An initial first panel 12 and five second panels 24 are obtained. An end second keyway 32 of each of the five second panels 24 is lowered into successive first keyways 20 of the first panels 12. Then, a second of the first panels 12 is obtained, and each successive of the first keyways 20 of this first panel 12 is lowered into the next-to-end second keyways 32 of each successive second panels 24. This process is repeated until the five-by-five matrix shown in FIG. 1 is obtained. It is noted that, after the panel middle portions 28 are placed in the respective panel-middle-portion reception spaces 51, the flexible vertical strut portions 44 of the flexible lock tabs snap into the lock-tab-receiving notches 46.

The interaction of the flexible lock tabs and the lock-tab-receiving notches 46, in combination with the panel middle portions is retained in the panel-middle-portion reception spaces 51, serve to effectively prevent the assembled matrix from coming apart unless actively disassembled. Stated somewhat differently, the first panels 12 and the second panels 24 are securely interlocked together.

A number of auxiliary bottom insert apparatuses 10, such as shown in FIG. 1, can be used together to cover a relatively large container bottom. On the other hand, if a relatively small container is to be employed, the first panels 12 and the second panels 24 can be shortened.

The fully assembled auxiliary bottom insert apparatus 10 of the invention can be used in a range of angular orientations between the first panels 12 and the second panels 24. As shown in FIG. 1, the first panels 12 can be oriented perpendicularly with respect to the second panels 24. Other orientations can be obtained by a person grasping diametrically opposite ends of panels in the matrix and either pushing the grasped panels towards each other or pulling the grasped panels away from each other. When such is done, the matrix is moved to an orientation The first panels 12 and the second panels 24 are no longer perpendicular to each other. In moving to or from a perpendicular orientation to a non-perpendicular orientation, the panel middle portions of either first or second panels and the panel-middle-portion reception spaces 51 of adjacent second or first panels form hinges around which the panels rotate.

A non-perpendicular orientation can be used in a free-standing mode or inside a container. In addition, when a non-perpendicular orientation is effectuated to its practical limit, the auxiliary bottom insert apparatus 10 can be considered to be in a folded or storage mode. The storage mode takes up less storage volume that the mode in which the first panels 12 and the second panels 24 are oriented perpendicular to each other.

The components of the auxiliary bottom insert apparatus for a container of the invention can be made from inexpensive and durable plastic or paper materials.

Although the preferred embodiment of the invention is disclosed herein as having particular utility as an auxiliary bottom insert apparatus for a container such as a cooler device, it will be appreciated that the apparatus according to the invention alternatively may be employed generally as a flexible divider or partition filler member for storing articles in a container in separate compartments, respectively, in a protected manner. Thus, it will be obvious to a person of ordinary skill in the packaging art that by varying the number of interlocking panels and their dimensions an insert apparatus incorporating the principles of the present invention may be obtained adapted to store a plurality of useful articles of virtually any type in a container in a separated and protected manner.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved auxiliary bottom insert apparatus for a container that is low in cost, relatively simple in design and operation, and which may advantageously be used in connection with a preferred embodiment to prevent food items on the floor of a cooler device from being wetted by liquid water that results from melted ice. With the invention, an auxiliary bottom insert apparatus for a container is provided which can retrofit a wide variety of cooler devices. With the invention, an auxiliary bottom insert apparatus for a container is provided which can be adjusted with respect to length and can adjusted with respect to width to retrofit cooler devices which have a variety of lengths and widths. With the invention, an auxiliary bottom insert apparatus for a container is provided which does not employ horizontal platforms that are supported by vertically oriented support structures. With the invention, an auxiliary bottom insert apparatus for a container provides an auxiliary floor unit that can optionally be used as a vertical divider to divide the interior of the cooler device into a plurality of compartments. With the invention, an auxiliary bottom insert apparatus for a container provides an auxiliary floor unit that can optionally be used as a support structure for supporting a vertical divider that divides the interior of the container (e.g. cooler device) into a plurality of compartments. With the invention, an auxiliary insert apparatus for a container provides a flexible divider for storing a plurality of articles in the container in separate compartments, respectively.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided: at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An auxiliary bottom insert apparatus for a container, comprising:

first panels, each of which includes a first panel top edge, a first panel middle portion, and a first panel bottom edge, wherein each of said first panels includes first keyways spaced at predetermined first increments along said first panel top edge and extending from said first panel top edge to said first panel middle portion, and second panels, each of which includes a second panel top edge, a second panel middle portion, and a second panel bottom edge, wherein each of said second panels includes second keyways spaced at predetermined second increments along said second panel top edge and extending from said second panel top edge to said second panel middle portion, wherein said first panels and said second panels include substantially identical dimensions and keyways, wherein said second panels are inverted with respect to said first panels, and wherein each of said first panel middle portions is inserted in a corresponding one of said second keyways and each of said second panel middle portions is inserted in a corresponding one of said first keyways, whereby said first panels and said second panels form a flexibly interlocked panel gridwork;

wherein each of said first keyways and said second keways includes:

a ramp portion extending from a respective top panel edge to a respective middle panel portion at an obtuse ramp angle with respect to said respective top panel edge, a key-reception well extending into a respective middle panel portion from said ramp angle, wherein each of said first panels and said second panels further includes:

a plurality of flexible lock tabs, wherein each lock tab extends from a respective panel top edge toward a respective middle panel portion and is positioned over a portion of a respective keyway in spaced confronting relation to said ramp portion, and a plurality of lock-tab-receiving notches, wherein each lock-tab-receiving notch extends from a respective panel bottom edge toward a respective said middle panel portion.

2. The apparatus of claim 1 wherein:

said gridwork has a first dimension and a second dimension, said first panels are set out at increments along a first dimension of said gridwork, and said first panels are perpendicular to said first dimension and parallel to said second dimension, said first keyways are set out at increments along said first panels, said second panels are set out at increments along a second dimension of gridwork, and said second panels are perpendicular to said second dimension and parallel to said first dimension, and said second keyways are set out at increments along said second panels.

3. The apparatus of claim 1 wherein said gridwork is in a form of a matrix wherein said first panels form matrix rows, said second panels form matrix columns and elements of the matrix are formed by ordered pairs of said first keyways and said second keyways.

4. The apparatus of claim 1 wherein:

said ramp angle is approximately one hundred thirty-five degrees, and a pair of walls of each of said key-reception wells are oriented at right angles to said respective top panel edge and said respective bottom panel edge of a respective panel.

5. The apparatus of claim 1 wherein each of said lock tabs and each of said key-reception wells in positioned on opposite sides of a respective panel middle portion.

6. The apparatus of claim 5 wherein:

each lock tab is L-shaped, having a horizontal strut portion and a vertical strut portion, and each lock-tab-receiving notch is a complementary L-shape.

7. The apparatus of claim 6 wherein, for each panel, a space between each key-reception well of each keyway and each horizontal strut portion forms a panel-middle-portion reception space.

* * * * *